United States Patent [19]

Perneczky

[11] Patent Number: 5,015,303

[45] Date of Patent: May 14, 1991

[54] LOW PROFILE ROLL CLEANING APPARATUS AND SELF ALIGNING BEARING USED THEREIN

[76] Inventor: George C. Perneczky, 8918 Biloba, Orland Park, Ill. 60462

[21] Appl. No.: 400,336

[22] Filed: Aug. 30, 1989

Related U.S. Application Data

[62] Division of Ser. No. 222,773, Jul. 22, 1988, Pat. No. 4,887,329.

[51] Int. Cl.[5] ..... B08B 1/04

[52] U.S. Cl. ..... 134/32; 134/33; 15/256.53; 198/498

[58] Field of Search ..... 15/256.53, 256.5; 162/281; 198/498, 499; 134/6, 32, 33; 51/67, 251, 252-253, 289 R, 68, 69, 67

[56] References Cited

U.S. PATENT DOCUMENTS

| | | | |
|---|---|---|---|
| 4,528,716 | 6/1985 | Perneczky | 15/256.51 |
| 4,633,999 | 1/1987 | Perneczky | 198/499 |
| 4,841,675 | 6/1989 | Perneczky | 51/67 |
| 4,887,329 | 12/1989 | Perneczky | 15/256.53 |

*Primary Examiner*—Anthony McFarlane
*Attorney, Agent, or Firm*—Roper & Quigg

[57] ABSTRACT

Method and apparatus for automatically cleaning a roll for handling sheet stock while in service, including single ended reciprocally actuated scrubbing of a fully roll surface width polishing surface swingingly engaged with the roll surface to provide effective cleaning action without leaving residual scars on the roll surface. Single ended actuation of the scrubbing action is enhanced with special self aligning bearings.

12 Claims, 5 Drawing Sheets

FIG. 4
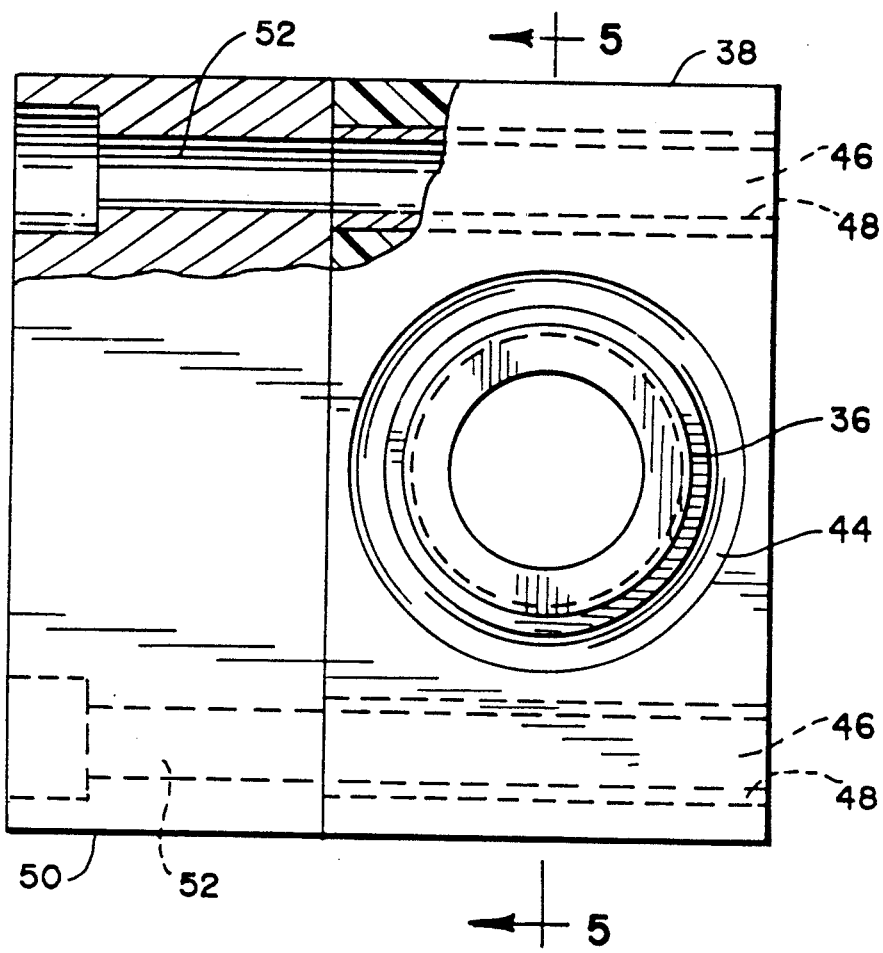
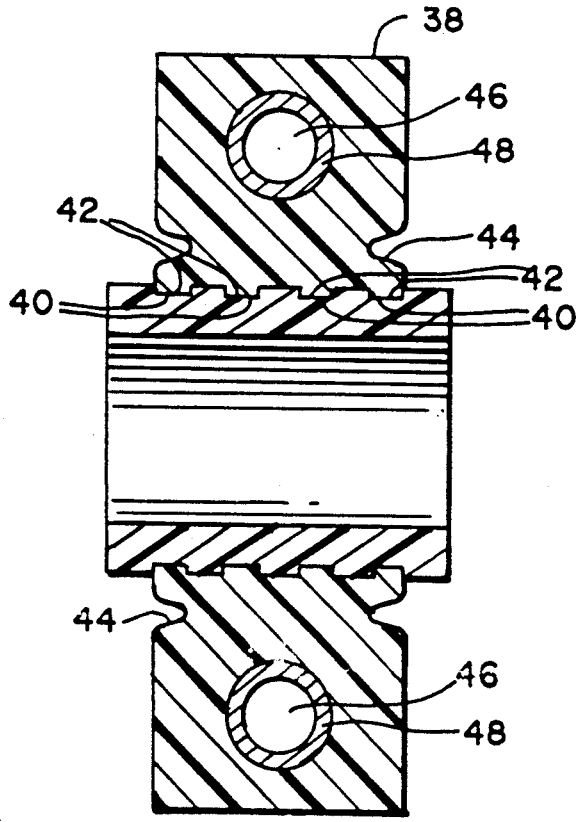
FIG. 5

LOW PROFILE ROLL CLEANING APPARATUS AND SELF ALIGNING BEARING USED THEREIN

This is a division of application Ser. No. 222,773 filed July 22, 1988, now U.S. Pat. No. 4,887,329, the text of which is hereby incorporated by reference.

BACKGROUND OF THE INVENTION

The present invention relates to roll cleaning systems, and more particularly to apparatus for an automatic self adjusting roll cleaning system.

Sheet stock, such as steel, plastic, aluminum and paper, is generally fed through a series of rolls, such as guide rolls and wringer rolls, as part of the manufacturing process. Such rolls serve to provide contact with the sheet stock for a variety of purposes, such as to guide or dry the sheet stock either before or after a coating process, as it is being cut to width, or as it is wound into large coils for ease of handling, storage and transportation. The surfaces of such rolls have a tendency to accummulate abrasive contaminants, corrosive coatings and particles of sheet stock on their surfaces, which can seriously mar and damage the surface of the sheet stock. Furthermore, such accumulations on the roll surfaces may embed themselves in the roll surfaces, scar the roll surfaces, or otherwise seriously damage them. It is therefore desirable to clean the surfaces of the rolls to prevent such accumulations from damaging both the sheet stock and the rolls themselves. Although it is possible to shut down a manufacturing operation to periodically change the rolls with fresh ones that have been cleaned, or to manually clean the rolls in service, it is generally uneconomic to do so, because the down time involved to stop and start the manufacturing operation is excessive.

Consequently, roll cleaning apparatus which functions during the manufacturing process is preferred. One such cleaning system in the prior art has been devised and developed by the Applicant of the present invention. This cleaning apparatus comprises a series of polishing blocks arranged on a polishing block support assembly in a tandem block arrangement having a total combined width at least as wide as the roll surface, and mounted tandem to a lever operated engagement system so that the operation of the lever engages the polishing blocks over the entire width of the roll surface. The polishing blocks are each resiliently mounted so that they each provide substantially the same surface pressure within a wide range of variation of polishing block wear between the different polishing blocks. However, their cleaning system is not completely satisfactory because the stationary polishing blocks so used have a tendency to leave a scarring pattern of their own.

An improved roll cleaning apparatus is described in U.S. patent application Ser. No. 193,596 entitled "Apparatus for Cleaning and Polishing Roll Assemblies", filed May 13, 1988, now U.S. Pat. No. 4,841,675 also to the Applicant of the present invention. This apparatus automatically engages and oscillates the tandem arrangement of polishing blocks described above on the roll surface. The oscillating motion of the blocks laterally scrub the roll surface as they polish to prevent any polishing block scarring pattern to develop. The oscillating feature of this apparatus is secured with a pneumatically actuated positioning cylinder for one end of the tandem polishing block arrangement on its polishing block support assembly and a hydraulically operated dampening cylinder for the other end. Each of the cylinders is individually supported into position with its own pneumatic support assembly. This arrangement provides automatic alignment of the polishing block support assembly with the roll surface at a regulated pressure. Furthermore, separate cylinders for each end of the polishing block support assembly prevent bearing misalignment problems.

Although this apparatus is very satisfactory from the standpoint of performance, it is bulky, complex and expensive. A roll cleaning apparatus which has a simpler polishing block engagement system, combined with a simple single ended positioner for reciprocally oscillating the polishing block support assembly, is more suitable for many applications with restrictive economic or physical space requirements. However, a simple end driven block support assembly requires some sort of means for preventing axial misalignment during operation, or alternatively, some means for successfully operating with large amounts of axial misalignment.

A major limitation of axial misalignment tolerance for axially reciprocating systems is bearing design. Although various bearing designs allowing axial motion are known which have a certain amount of either rotational freedom of movement about a point, or lateral freedom of movement relative to an axis, there are none that have a tolerance for both rotational and lateral misalignment combined.

OBJECTS OF THE INVENTION

Therefore, one object of the present invention is to automatically clean rolls for handling sheet stock during manufacturing operations.

Another object of the invention is to clean rolls for handling sheet stock without leaving any scarring patterns on the roll surfaces.

Yet another object of the present invention is to reciprocally scrub the surface of rolls for handling sheet stock while cleaning them.

Still another object of the present invention is to linearly actuate an automatic cleaning and scrubbing operation for rolls from one end of the rolls.

A further object of the invention is to supportably retain an automatic roll cleaning and scrubbing operation over a wide latitude of lateral and rotational displacement of reciprocal linear actuation.

SUMMARY OF THE INVENTION

The present invention achieves the above stated objects, as well as other advantages described herein, by means of a roll surface engagable polishing block surface, having a width greater than the roll surface and rotatably mounted to a support assembly, with the support assembly retained by self aligning bearings to permit reciprocal actuation by a single linear actuator coupled to one of the ends of the support assembly.

The self aligning bearings allow a simple single end actuated configuration for the cleaning apparatus, and this arrangement is both less complex and less bulky in design than prior art roll polishing apparatus which include a reciprocating scrubbing action. Furthermore, the simple end driven configuration allows engagement of the roll cleaner with the roll surface using a simple lever system, for temporary selective engagement of polishing action, or a counterweight system, for continuous engagement of polishing action. The linear configuration lends itself to a low profile design usable in cramped installation areas.

DESCRIPTION OF THE DRAWINGS

FIG. 4 is a detailed view of the self aligning bearings shown in FIGS. 1 and 2.

FIG. 5 is a cross-sectional view of the self aligning bearing shown in FIG. 4 along line 5—5.

DESCRIPTION OF THE PREFERRED EMBODIMENT

Figure 2:
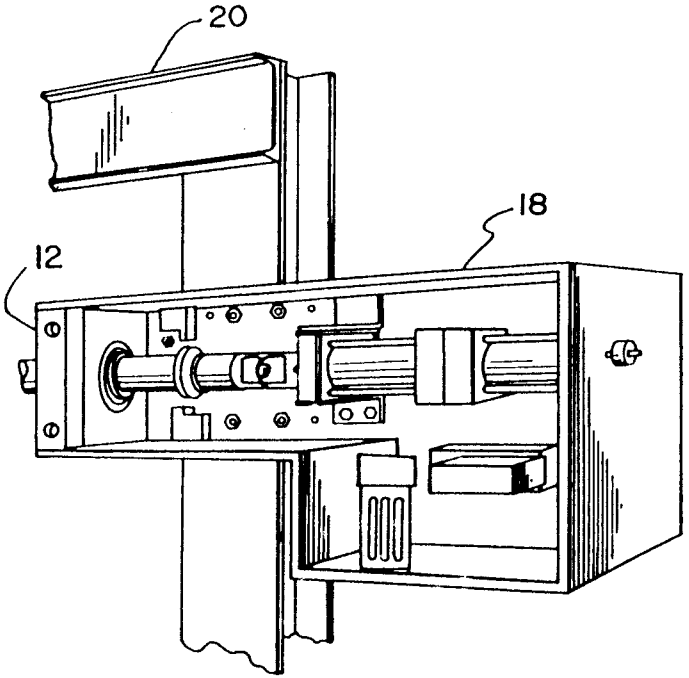
FIG. 2 is a reciprocal linear actuator suitable for driving the preferred embodiment of the invention shown in FIG. 1.
Figure 1:
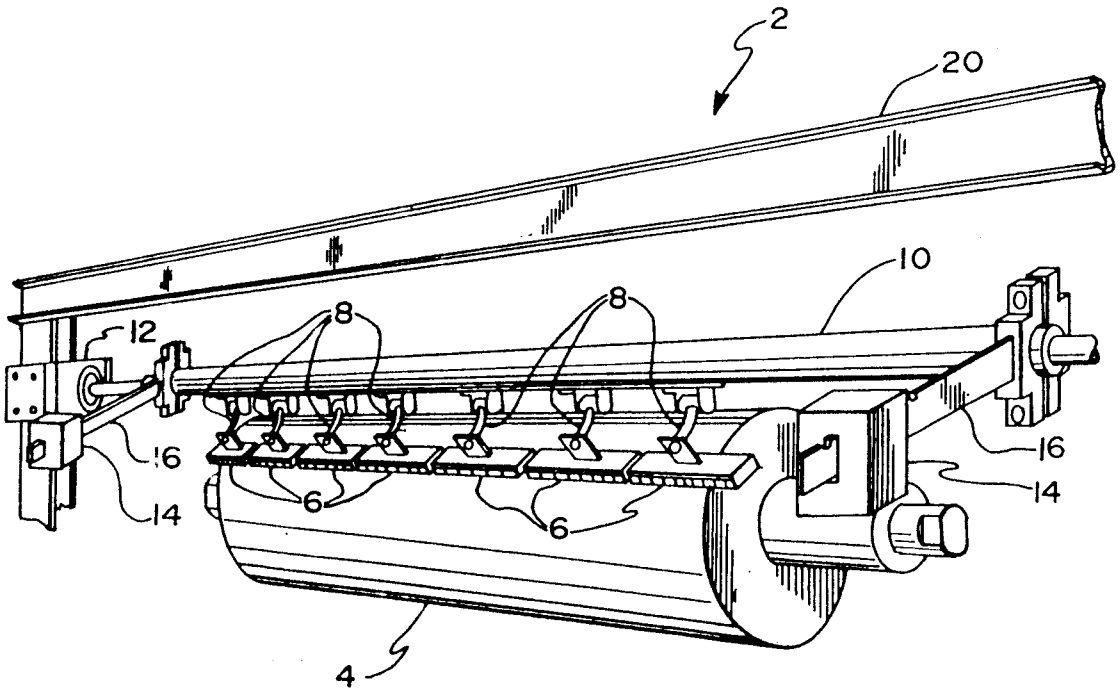
FIG. 1 is a preferred embodiment of the present invention, suitable for coupling to a reciprocal linear actuator.

Referring to the drawings, wherein reference characters designate like or corresponding parts throughout the views, FIGS. 1 and 2 show different sections of a preferred embodiment of the present invention adapted to continuous cleaning of a guide roll. A roll polishing assembly 2 according to the present invention adapted for continuous roll surface cleaning is shown engaged with the circulating surface of a guide roll 4. Alternately, the roll polishing assembly 2 can engage other types of circulating surfaces for cleaning purposes, such as the surface of a conveyor belt. Included in the roll polishing assembly 2 are a bank of polishing blocks 6 which are tandemly arranged across the surface of the roll 4 to provide a continuous polishing surface which extends over a width greater than that of the surface of roll 4. Alternatively, the bank of polishing blocks 6 can be a single polishing block extending over the same width.

The polishing blocks 6 are retained in serial alignment by resilient block mounting brackets 8 which are attached to a linear support assembly 10. Each polishing block 6 should have at least one mounting bracket 8. The support assembly 10 is rotatably supported by self aligning bearings 12 so that rotary motion of the support assembly 10 can controllably engage the polishing blocks 6 on the surface of the roll 4 with any desired degree of force. To establish the desired degree of force, counterweights 14 provide a biasing torque on the support assembly 10 through counterweight levers 16, the counterweight levers 16 being rigidly fastened to the support assembly 10. The biasing torque supplied by the counterweights 14 is easily adjusted to provide the desired force of the polishing blocks 6 on the surface of the roll 4 by shifting the position of the counterweights 14 on the counterweight arms 16. Although the counterweight arms 16 are each shown with a plurality of notches provided to engage the counterweights 14 along a mating protrusion within their cavities through which the counterweight arms 16 penetrate, to provide predetermined force adjustment positions, smooth counterweight arms can be used instead. The counterweights 14 may include setscrews (not shown) to lock the counterweights 14 to their respective counterweight arms 16 whether or not the counterweight arms 16 include adjustment notches. Alternatively, other biasing arrangements can be used in place of the counterweights 14, such as springs, pneumatic or hydraulic cylinders, or torsion bars. Furthermore, it may be convenient to provide only one counterweight 14 and counterweight arm 16, or other biasing arrangement, or more than two counterweights 14 and counterweight arms 16.

The support assembly is reciprocally driven by a linear actuator 18 coupled to one end of the support assembly 10. The self aligning bearings 12 allow axial movement of the support assembly 10 through a wide range of lateral and angular displacement. Consequently, the longitudinal axis of the support assembly 10 may shift from that of the linear actuator 18 through a significant range without adverse effect upon the reciprocating operation of the roll polishing assembly 2. The linear actuator 18 may comprise any sort of actuator that can be operated in a linear reciprocating mode. The linear actuator 18 is shown in FIG. 2 as a pneumatically operated device with hydraulic dampening, which is one convenient and easily implemented actuator system.

The roll polishing assembly 2 is mounted proximate the surface of the roll 4 such that the longitudinal axis of the support assembly 10 is parallel to that of the roll 4. The resilient block mounting brackets 8 have sufficient length to establish a drag angle between the contact points of their respective polishing blocks 6 and the plane formed by the longitudinal axes of the support assembly 10 and the roll 4. The drag angle for the polishing blocks improves surface contact, with a drag angle value of 10 to 50 degrees being very desirable. The roll cleaning assembly 2 may be retained proximate the roll 4 with any convenient mounting arrangement, such as the mounting bracket 20 shown in FIG. 1.

Figure 3:
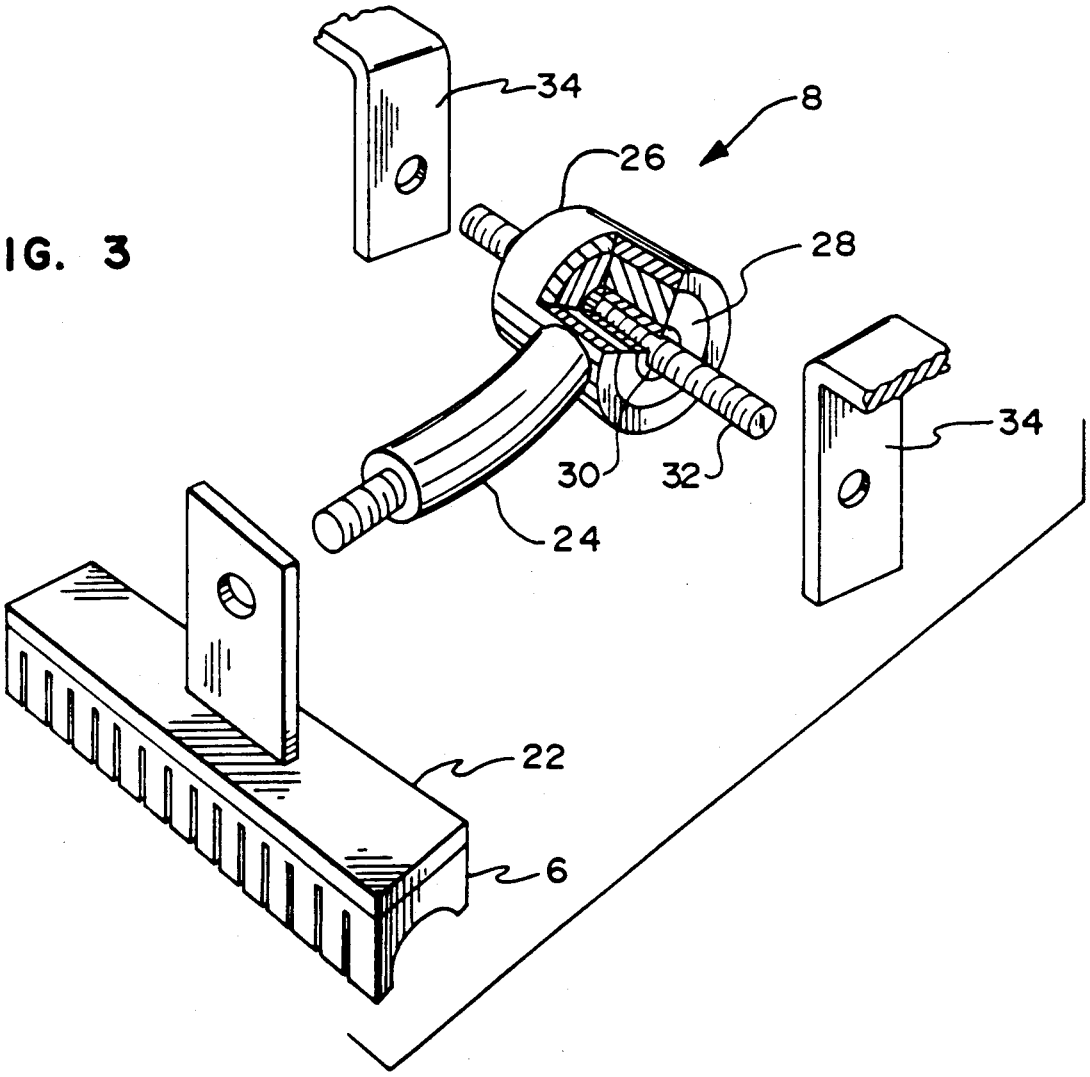
FIG. 3 is an exploded view of the polishing block mounting arrangement for the preferred embodiment of the present invention shown in FIG. 1.

Although the resilient block mounting brackets 8 may have a variety of configurations as long as they have sufficient length to secure a desirable polishing block drag angle as described above, an exploded view of one convenient arrangement for the resilient block mounting brackets 8 is shown in FIG. 3. The polishing block 6 is coupled to a block mounting surface bracket 22 by adhesive bonding, for instance, and the block mounting surface bracket 22 is coupled to a mounting bracket extension arm 24.

The end of the extrusion arm 24 coupled to the block mounting surface bracket 22 may conveniently be a threaded rod, for insertion into a mating hole in the block mounting surface bracket 22, and coupling with a corresponding threaded nut (not shown) to allow rotational adjustment of the polishing block 6 transversely to the longitudinal axis of the extension arm 24. The end of the extension arm 24 opposite the end for coupling to the block mounting surface bracket 22 is coupled to a coupling sheath 26. The coupling sheath 26 encases a resilient collar 28 for a tubular mounting insert 30. The sheath 26, collar 28 and insert 30 are arranged on the extension arm 24 so that the longitudinal axis of the insert 30 is substantially parallel to the longitudinal axis of the block surface mounting bracket 22.

The insert 30 retains a mounting bracket stud 32 which has its end extending outwardly beyond the length of the insert 3). Conveniently, the stud 32 may be threaded, both to engage the inner periphery of the insert 30, which may have, for instance, mating threads, and for coupling to mounting support brackets 34 on each end of the stud 32 with corresponding threaded nuts (not shown). The mounting support brackets 34 are therefore rotationally adjustable transversely to the longitudinal axis of the stud 30. The mounting support brackets 34 are fastened to the support assembly 10.

The extension arm 24 may be curvilinear as shown to increase the effective contact area of the polishing blocks 6. The insert 30 and stud 32 may comprise a single unified structure, if desired. Likewise, the extension arm 24 and the sheath 26 may also comprise a single unitary structure. The resilient collar 28 may be any suitably resilient material which has the desired modulus of elasticity, such as an elastomeric material.

The self aligning bearings 12 are shown in detail in FIGS. 4 and 5. A rigid bearing insert 36 is encased in a resilient bearing block 38. The bearing insert 36 may be of any sort of material suitable for tubular bearing applications, such as ultra high molecular weight (UHMW) polyethylene, teflon, brass, aluminum or steel. UHMW polyethylene and teflon are both preferred materials for this application because they are lubrication free. The resilient bearing block 38 may be of any resilient material that has the desired modulus of elasticity, such as an elastomeric material. The bearing insert 36 and the resilient bearing block 38 should have mating surfaces which resist separation from each other to prevent the bearing insert 36 from sliding out of the resilient bearing block 38. To this end, the bearing insert 36 and the resilient bearing block 38 may have mating surfaces which include a plurality of mating annular bearing grooves 40 and bearing block ridges 42, as shown in FIG. 4. The resilient bearing block 38 may also include annular surface grooves 44 which surround the ends of the bearing insert 36 on each side of the resilient bearing block 38. The annular surface grooves 44 enhance rotational displacement of the longitudinal axis of the bearing insert 36. The resiliency of the bearing block 38 allows lateral displacement of the longitudinal axis of the bearing insert 36, so that the self aligning bearing assembly 12 has a bearing axis which can both laterally and rotationally deviate from its normal position to a substantial degree.

The self aligning bearing assembly 12 is shown with two linear block mounting holes 46 through the bearing block 38 for mounting purposes. Rigid hole liners 48 line the perimeter of the block holes 46 to provide a rigid mounting through the block holes 46. The rigid hole liners 48 may be any rigid material which has the desired degree of structural strength, such as aluminum, brass, plastic or steel. Also shown in FIG. 5 is a rigid mounting crown 50 which provides a rigid clamping surface for clamping the resilient bearing block 38 on a mounting surface (not shown). The mounting crown 50 includes crown holes 52 which line up with the block holes 46 to permit bolts (not shown) to be engaged through the holes 46 and 50 to fasten the crown 50 and the resilient bearing block 38 to the mounting surface. The crown 50 may be of any desired thickness to serve as a convenient filler block, or it may be deleted entirely if mounting clearances are minimal.

Likewise, the self aligning bearing assembly 12 may have other mounting arrangements. For instance, the bearing block 38 may have a cylindrical configuration to be mounted in a cylindrical recess, and retained with retainer rings, for instance. The block mounting holes 46 for the self aligning bearing assembly 12 may be oriented transverse to the orientation shown so that their axes are parallel to that of the bearing insert 36.

Figure 6:
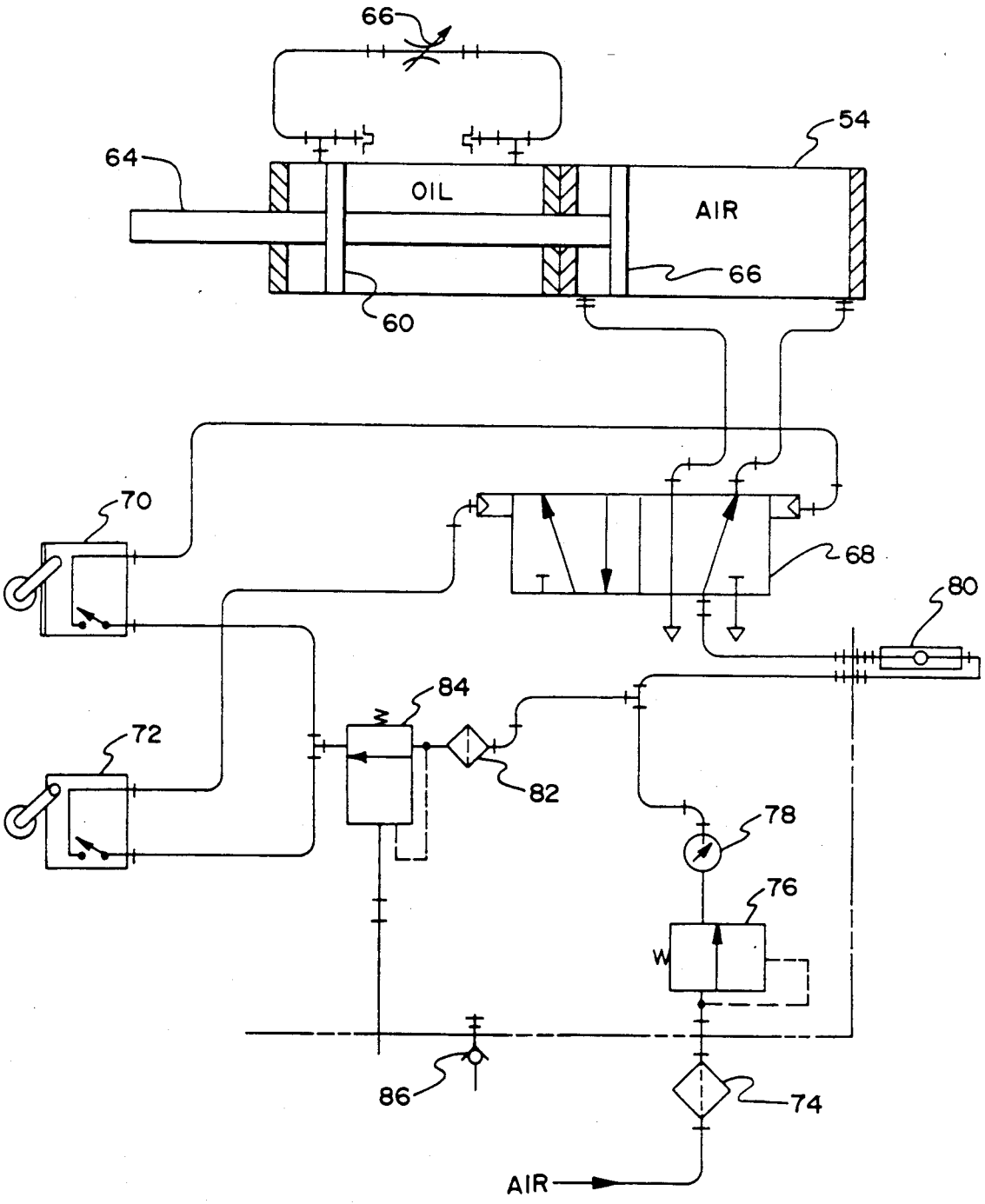
FIG. 6 is a schematic diagram of the reciprocal linear actuator shown in FIG. 2.

FIG. 6 is a schematic diagram of the linear actuator 12. A tandem reciprocating actuator cylinder 54 includes an air piston 56 in an air cylinder section 58 and an oil piston 60 in an oil cylinder section 62, with the air piston 56 and oil piston 60 tandemly coupled to an actuator shaft 64. The damping cylinder section 62 dampens motion of the actuator cylinder 54 because oil contained in the cylinder must flow through a needle valve 66 when the actuator shaft 64 into or out of the actuator cylinder 54. The needle valve may include adjustable flow restriction to regulate the dampening action as desired.

The actuator cylinder is controlled by a pilot pressure operated control valve 68. The four way valve is operated by pilot pressure supplied from two mechanically operated air limit switches 70, 72. The air limit switches 70, 72 are operated by the actuator shaft 64 at the limits of its desired travel. The control valve 68 and the air limit switches 70, 72 are all supplied with air supply pressure fed through a system air filter 74. Air pressure is directed to the control valve 68 from the system filter 74, first through a system pressure relief valve 76, which is set to a desired system air pressure monitored by an air pressure gauge 78, and then through a shut off valve 80. Although shown as a manually operated ball valve, the shut off valve 80 may be a solenoid on pressure operated valve for automatic or remote operation, operated by any desired source. The air pressure is directed to the air limit switches 70, 72 from the system pressure relief valve 76, first through a pilot system air filter 82, and then through a pilot pressure relief valve 84, which is set to a desired pilot pressure which is generally less than the desired system pressure. Motion of the actuator shaft 64 out of the actuator cylinder 54 trips the limit switch 72 when the actuator shaft reaches the end of its travel, letting pilot pressure flow through it to the control valve 68. The control valve 68 responds to the pilot pressure from the limit switch 72 by directing the system pressure to the air cylinder section 58 to cause the actuator shaft 64 to reverse its direction, and move into the actuator cylinder 54. When the actuator shaft 64 reaches the end of its inward travel, the limit switch 70 is tripped, letting pilot pressure flow through the limit switch 70 to the control valve 68. The control valve 68 responds to the pilot pressure from the limit switch 70 by directing the system pressure to the air cylinder section 58 to the air cylinder section 58 to cause the actuator shaft 64 out of the actuator cylinder once again. Thus, a continuous reciprocal action of the actuator shaft 64 is produced. The limit switches 70, 72 may be mounted and actuated to obtain any desired stroke, and the rate of reciprocation of the actuator shaft 64 may be controlled by adjusting the flow restriction of the needle valve 66. Reciprocation can be stopped by blocking the system to the control valve 68 with the shut off valve 80. A check valve 86 may be included to maintain the enclosure for the linear actuator 18 above atmosphere pressure, allowing venting of the enclosure of the actuator 18, but preventing contaminants from entering the enclosure of the linear actuator 18 when the linear actuator 18 is in operation, since the enclosure for the linear actuator 18 is then above atmospheric pressure.

Figures 7, 8:
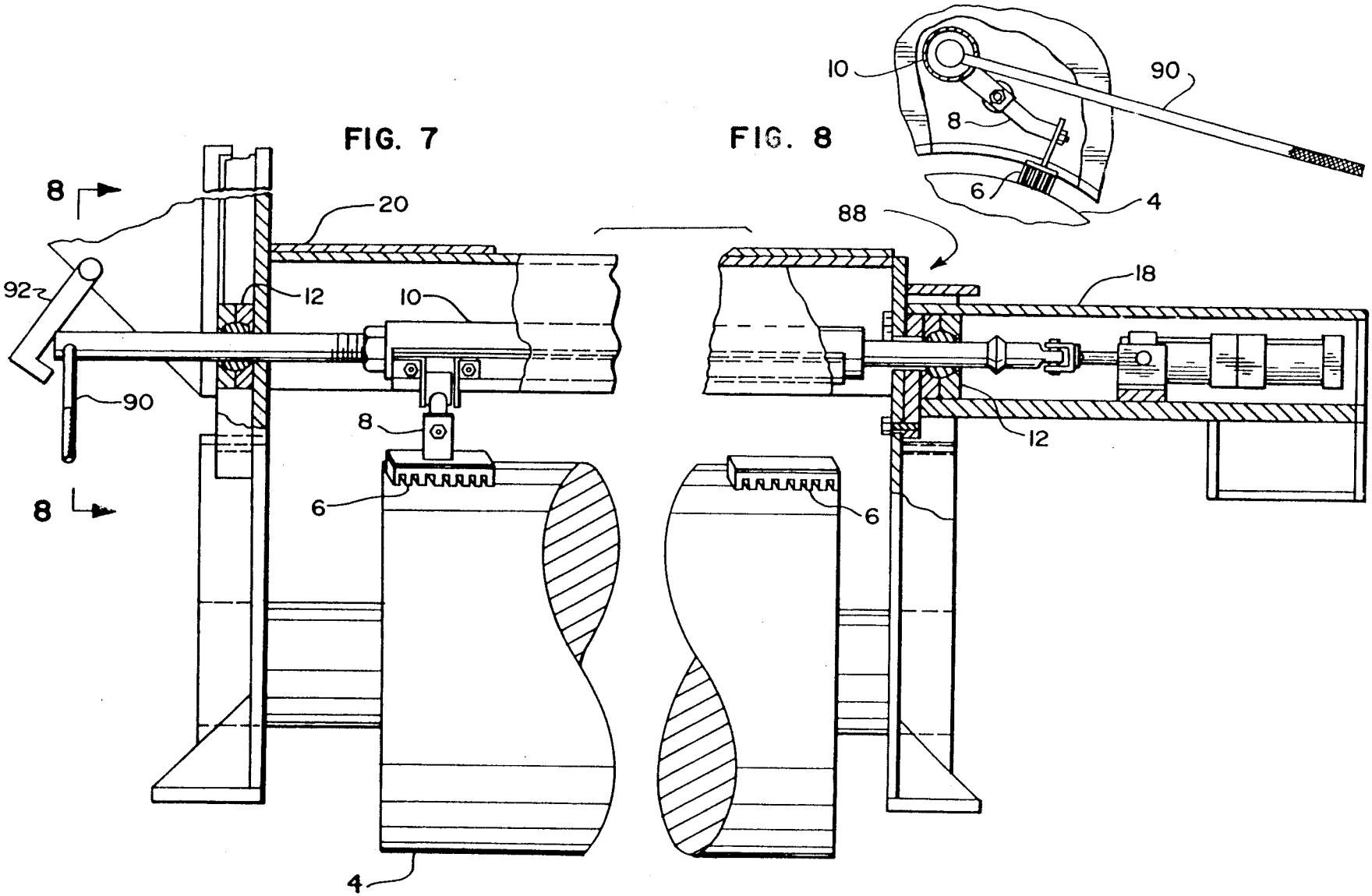
FIG. 7 is an alternate embodiment of the present invention suitable for intermittent roll surface cleaning.
FIG. 8 is a partial cross sectional view of the alternate embodiment of the present invention shown in FIG. 7 along line 8—8.

FIGS. 7 and 8 show different views of an alternative embodiment of the present invention adapted for temporary selective engagement of roll cleaning. A roll cleaning assembly 88 has the same general configuration as described above for the roll cleaning assembly 2 shown in FIGS. 1 and 2, including the polishing blocks 6 retained in serial alignment by the resilient mounting brackets 8 attached to the support assembly 10. Likewise, the support assembly 10 is rotatable supported by the self aligning bearings 12 so that the support assembly 10 can controllably engage the polishing blocks 6 on the surface of the roll 4. Similarly too, the roll cleaning assembly 88 includes the linear actuator 18, and the roller cleaning assembly 83 is again shown retained with the mounting bracket 20. However, to engage the polishing blocks 6 on the surface of the roll 4, a lever 90, coupled to the support assembly 10, is manually operated. The force applied to operate the lever determines the biasing torque supplied to the support assembly 10, instead of the counterweights 14 on the counterweight lever 16, as with the roll cleaning assembly 2. The linear actuator 18 operates the roll cleaning assembly 88 just as explained above for the roll cleaning assembly 2. The lever 90 allows selective engagement of the polishing blocks 6 for applications where only occasional cleaning of the surface of the roll 4 is desired. A latch 92, mounted in any convenient location, such as the mounting bracket 20, may be used to hold the lever 90 in a desired position to keep the polishing blocks 6 disengaged from the surface of the roll 4 for long periods.

Thus, there have been herein described different embodiments of the present invention which both provide single ended actuation of a full roll surface width polishing surface to reciprocally scrub a guide or wringer roll surface when cleaning the roll surface while the roll is in service. It will be understood that various changes in the details, arrangements and configurations of parts and systems which have been herein described and illustrated in order to explain the nature of the invention may be made by those skilled in the art within the principle and scope of the invention as expressed in the appended claims.

I claim:

1. A method of automatically cleaning contaminants from a surface moving in rotational motion, with said surface having a width along the longitudinal axis of said rotational motion, comprising the steps of:

orienting at least one polishing block for polishing said moving surface with the longitudinal axis of said polishing block parallel to the longitudinal axis of said rotational motion;

swingingly engaging said polishing block with said moving surface about an axis of rotation; and reciprocally scrubbing said moving surface with said polishing block being reciprocally moved along the width of said moving surface.

2. The method recited in claim 1, wherein said reciprocal scrubbing step includes reciprocating said polishing block from said axis of rotation to said moving surface.

3. The method recited in claim 2, wherein said reciprocal scrubbing step includes reciprocally scrubbing the entire width of said moving surface simultaneously.

4. The method recited in claim 3, wherein said swingingly engaging step further includes the step of force biasing said polishing block against said moving surface.

5. The method recited in claim 4, wherein said force biasing step further includes continuously force biasing said polishing block against said moving surface for continuous cleaning of the width of said moving surface.

6. The method recited in claim 4, wherein said force biasing step further includes selectively force biasing said polishing block against the width of said moving surface for intermittent cleaning the width of said moving surface.

7. The method recited in claim 1, wherein said at least one polishing block comprises a plurality of polishing blocks.

8. The method recited in claim 7, wherein said reciprocal scrubbing step includes reciprocating said plurality of polishing blocks from said axis of rotation to said moving surface.

9. The method recited in claim 8, wherein sid reciprocal scrubbing step includes reciprocally scrubbing the entire width of said moving surface simultaneously.

10. The method recited in claim 9, wherein said swingingly engaging step further includes the step of force biasing said polishing block against said moving surface.

11. The method recited in claim 10, wherein said force biasing step further includes continuously force biasing said plurality of polishing blocks against said moving surface for continuous cleaning of the width of said moving surface.

12. The method recited in claim 10, wherein said force biasing step further includes selectively force biasing said plurality of polishing blocks against the width of said moving surface for intermittent cleaning the width of said moving surface.

* * * * *